US007769581B2

(12) United States Patent
Gerlach

(10) Patent No.: US 7,769,581 B2
(45) Date of Patent: Aug. 3, 2010

(54) METHOD OF CODING A SIGNAL USING VECTOR QUANTIZATION

(75) Inventor: Christian Georg Gerlach, Ditzingen (DE)

(73) Assignee: Alcatel, Paris (FR)

( * ) Notice: Subject to any disclaimer, the term of this patent is extended or adjusted under 35 U.S.C. 154(b) by 1135 days.

(21) Appl. No.: 10/617,210

(22) Filed: Jul. 11, 2003

(65) Prior Publication Data

US 2004/0030549 A1 Feb. 12, 2004

(30) Foreign Application Priority Data

Aug. 8, 2002 (EP) ..... 02017836

(51) Int. Cl.
*G10L 19/00* (2006.01)
*G10L 19/12* (2006.01)

(52) U.S. Cl. ..... 704/222; 704/201; 704/221

(58) Field of Classification Search ..... 704/201, 704/218, 222–223, 230
See application file for complete search history.

(56) References Cited

U.S. PATENT DOCUMENTS 4,060,694 A * 11/1977 Suzuki et al. ..... 704/252
4,817,157 A * 3/1989 Gerson ..... 704/230
4,868,867 A * 9/1989 Davidson et al. ..... 704/223
4,896,361 A 1/1990 Gerson
6,199,040 B1 * 3/2001 Fette et al. ..... 704/222
6,556,966 B1 * 4/2003 Gao ..... 704/220
6,785,646 B2 * 8/2004 Wang et al. ..... 704/223
6,789,059 B2 * 9/2004 Kandhadai et al. ..... 704/216

OTHER PUBLICATIONS

Kwan et al, "Implementation of DSP-RAM: An Architecture for Parallel Digital Signal Processing in Memory", Canadian Conference on Electrical and Computer Engineering, 2001, vol. 1, May 13-16, 2001, pp. 341-345.*
Ngwa-Ndifor et al, "A fast search algorithm for speech vector quantisation," Telecommunications, Consumer and Industrial Applications of Speech Technology, IEE Colloquium on, May 14, 1992, pp. 2/1-2/5.*
Cuhadar et al, "A scalable parallel approach to vector quantization," Real-Time Imaging, vol. 2, No. 4, Oct. 1996, pp. 241-247.*
Wang et al, "DSP-RAM: A logic-enhanced memory architecture for communication signal processing," Communications, Computers and Signal Processing, 1999 IEEE Pacific Rim Conference on, 1999, pp. 475-478.*
Wang Y-S et al: "TMS320C30 DSP based implementation of a half rate CELP coder" Proceedings of the International Conference on Acoustics, Speech and Signal Processing (ICASSP), New York, IEEE< US, vol. 4, Mar. 23-26, 1992, pp. 369-372, XP010059088.
Nakada A et al: "A Fully Parallel Vector-Quantization Processor for Real-Time Motion-Picture Compression" IEEE Journal of Solid-State Circuits, IEEE Inc. New York, US, vol. 34, No. 6, Jun. 1999, pp. 822-829, XP000913036.

* cited by examiner

*Primary Examiner*—James S Wozniak
(74) *Attorney, Agent, or Firm*—Sughrue Mion, PLLC

(57) ABSTRACT

The present invention relates to a method of coding a signal, in particular an audio or speech signal, wherein a codebook comprising k code vectors is provided for vector quantization of a signal vector representing a set of signal values of said signal(s), and wherein an optimal code vector of said codebook is determined by performing a codebook search. Parallelism is employed to accelerate the coding procedure. In particular, the codebook search is highly parallelised.

15 Claims, 3 Drawing Sheets

METHOD OF CODING A SIGNAL USING VECTOR QUANTIZATION

The invention is based on a priority application EP 02017836.4 which is hereby incorporated by reference.

BACKGROUND OF THE INVENTION

The present invention relates to a method of coding a signal, in particular an audio or speech signal, wherein a codebook comprising k code vectors is provided for vector quantization of a signal vector representing a set of signal values of said signal, wherein an optimal code vector of said codebook is determined by performing a codebook search.

The present invention further relates to a processor and a coder/decoder (CODEC), in particular speech and/or audio CODEC.

State-of-the-art speech coding systems employ algorithms based on vector quantization for coding speech and/or audio data that is to be transmitted at very low bit rates. Since these algorithms require a great deal of computational power, systems based thereon, e.g. gateways, transcoders or mobile switching centers, are very expensive.

Consequently, it is an object of the present invention to propose an improved method of coding a signal which requires less computational power.

SUMMARY OF THE INVENTION

This object is achieved by performing said codebook search in parallel by dividing said codebook into p codebook groups, by simultaneously determining p optimal group code vectors each of which corresponds to one of said p codebook groups, and by determining said optimal code vector among said p optimal group code vectors.

Since modern processors often provide for a plurality of calculation units that can perform additions and/or multiplications within one machine cycle, it is possible to simultaneously execute various steps of said codebook search in parallel. Since codebook search operations corresponding to one code vector often depend on preceding operations, however, simultaneous execution of a plurality of search operations corresponding to a single code vector is possible only to a limited extent.

Therefore it is proposed to subdivide an existing codebook into p codebook groups, each of which contains e.g. 1/p-th of the number k of code vectors contained in said codebook.

Though it is not necessary that each codebook group has the same number k/p of code vectors, this is the preferred embodiment since in this case codebook search takes about the same time for each codebook group.

Further codebook search comprises simultaneously determining p optimal group code vectors each of which corresponds to one of said p codebook groups. The calculations necessary for evaluating the optimal group code vector of one codebook group are independent from calculations conducted within any other codebook group. Hence these calculations can be performed in parallel, wherein a plurality of calculation units is advantageously employed.

After this step, p optimal group code vectors are obtained. Each group code vector represents the best result of a local codebook search limited to the corresponding codebook group.

Finally, the p optimal group code vectors are compared to each other so as to find the optimal code vector of the entire codebook. These comparisons can also be performed in parallel.

Since the codebook search is one of the most complex parts within speech CODECs using vector quantization, the parallel codebook search in said codebook groups according to the invention results in a significant performance gain of the overall procedure. For instance, if p=2 is chosen, the codebook search time is reduced to nearly half the processing time as compared to prior art systems.

According to an advantageous embodiment of the present invention, said step of determining said optimal code vector among said p optimal group code vectors comprises evaluating an index of each optimal group code vector uniquely identifying each optimal group code vector within said codebook.

Codebook search is conducted in a sequential order within standardized prior art methods. Parallelizing portions of the codebook search can lead to results which are different from those obtained with a standardized method regarding the optimum code vector, i.e. the coding method employing parallelism within codebook search might not have conformity with said standards. Especially, this can be the case if there are different data/number formats and overflow handling routines.

According to the present invention, this problem is solved by evaluating said index of said optimal group code vectors, which is explained in detail below. A comparison of the index values of the optimal group code vectors ensures conformity, which has been proven.

According to further embodiment of the present invention ithe vector quantization is of the shape-gain type, wherein a code vector from said codebook is multiplied by a so-called gain factor prior to further processing.

According to yet another advantageous embodiment of the present a comparison of code vectors is performed within said codebook search, wherein said comparison is based on a cross multiplication expression $$C_t * E_{best} > < E_t * C_{best},$$

which is based on fixed point operations and leads exactly to the same result as a standardized serial algorithm, wherein $C_t$ is a so-called cross term corresponding to a t-th code vector and $C_{best}$ is the cross term corresponding to a temporarily best code vector, and wherein $E_t$ is a so-called energy term corresponding to said t-th code vector and $E_{best}$ is the energy term corresponding to said temporarily best code vector.

In this codebook search, a scalar performance measure for said t-th code vector within said comparison is used, which is defined by the ratio $C_t/E_t$ of said cross term C and said energy term E, and within said comparison of said codebook search, the optimal code vector having the largest ratio $C_t/E_t$ is determined.

To simplify and accelerate calculation steps required for comparing the ratio $C_{best}/E_{best}$ of the temporarily best code vector with the ratio $C_t/E_t$ of the t-th code vector, the above mentioned cross multiplication expression is used for avoiding division operations.

Said comparison is employed for determining said group code vectors of said codebook groups, and to ensure conformity with standards such as ITU-T G.723.1, ITU-T G.729, GSM enhanced full-rate (EFR), GSM norrowband (NB) AMR and GSM wideband (WB) AMR regarding the optimal code vector, if there are several group code vectors with equal ratios C/E or cross multiplication expressions, respectively, the group code vector having the smallest index is chosen as optimal code vector.

According to another very advantageous embodiment of the present invention, wherein said method of coding is based on a code excited linear prediction (CELP-) algorithm comprising a synthesis section, elements of a matrix representing a transfer function of at least one filter of said synthesis section, and/or elements of auto-correlation matrices used within said CELP-algorithm and/or further precalculation and postcalculation steps for a/said comparison of code vectors are generated/evaluated in parallel. This leads to an acceleration of the calculations performed within the CELP-algorithm which is proportional to the degree of parallelism achieved.

Significant savings of execution time can especially be achieved by parallel processing of the elements of said auto-correlation matrices because these must be cyclically re-calculated depending on a periodicity of the algorithm.

According to a further advantageous variant of the present invention, said codebook comprises pulse code vectors.

As a further solution to the object of the present invention, a method is proposed, which is characterized in that a processor with configurable hardware and/or with acceleration means specifically designed for said method is used for parallel execution of steps of said method. Using such a processor on the one hand reduces coding overhead when specifying computer programs capable of performing the method according to the invention, and on the other hand, optimal acceleration of coding steps such as the codebook search and so on is guaranteed.

According to a further very advantageous embodiment of the present invention the processor provides means for simultaneously accessing a plurality of said signal values located in a memory. For instance, if said signal values of said audio or speech signal to be coded or of said auto-correlation matrices are represented by 16 bit data words, a 64 bit read instruction provided by the processor allows for simultaneously accessing four signal values located in said memory. This is especially advantageous since parallel processing of coding steps of e.g. speech coding often requires a plurality of input data words delivered to calculation units of the processor simultaneously, too.

As a further solution to the object of the present invention, a processor capable of performing the method according to the invention is proposed.

Yet a further solution to the object of the present invention comprises a coder and decoder (CODEC), in particular speech and/or audio signal CODEC, which is capable of performing the method according to the invention.

BRIEF DESCRIPTION OF THE DRAWINGS

Further features and advantages of the present invention are explained in more detail below with the aid of the accompanying drawings.

FIG. 1 shows a codebook CB comprising 1024 code vectors c_0, . . . , c_1023 which are uniquely identifiable within said codebook CB via an index ranging from 0 to 1023.

Figure 2:
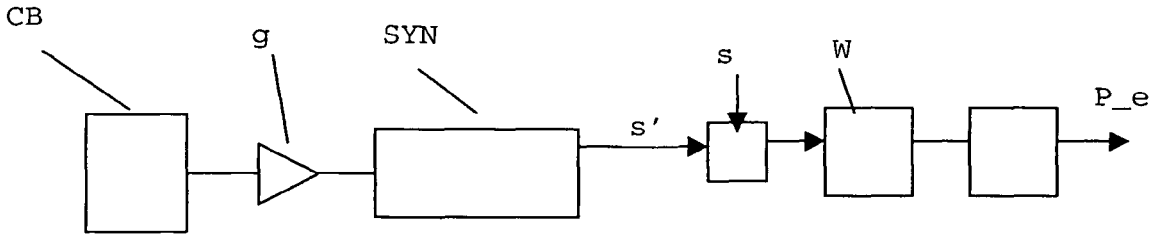
FIG. 2 shows a schematic block diagram of an embodiment of the present invention.
Figure 3:
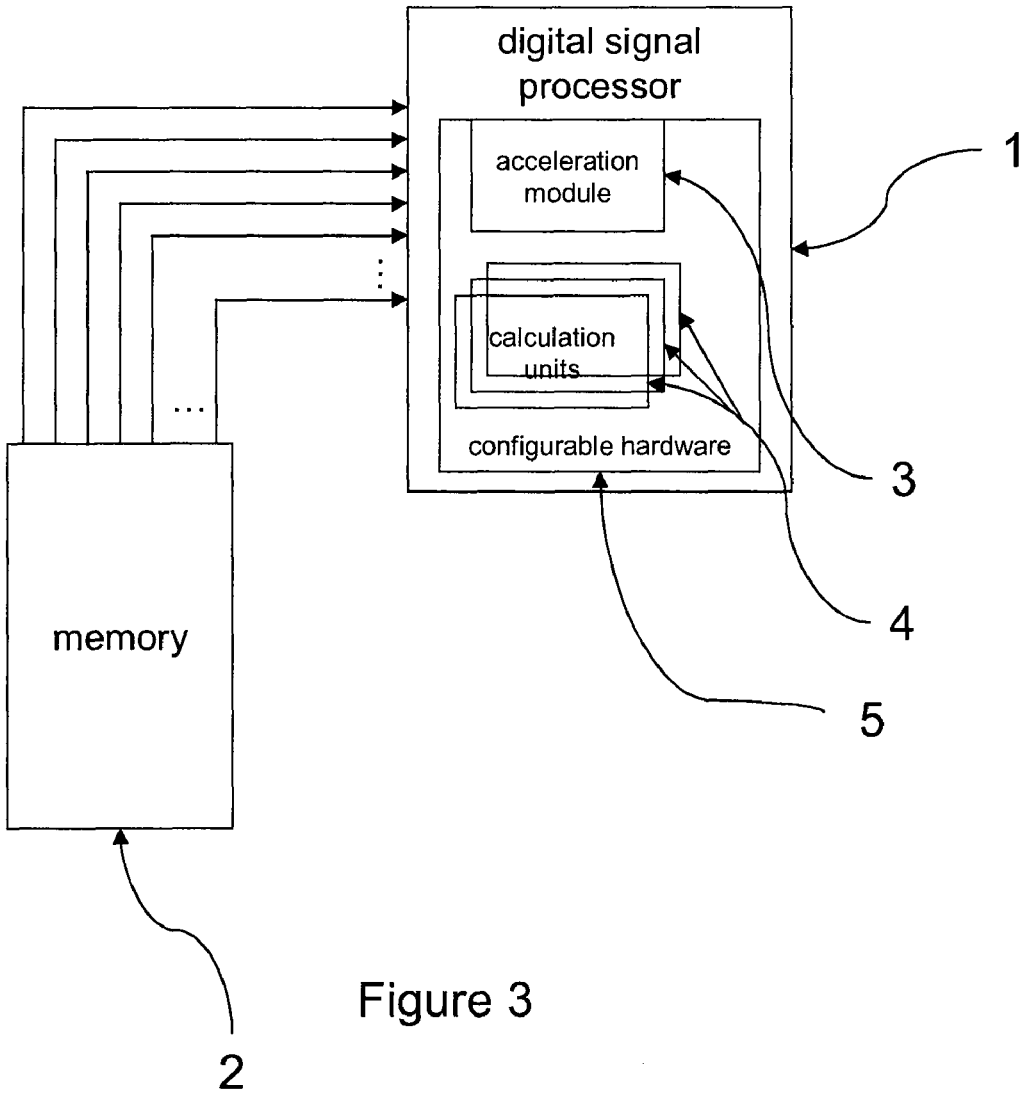
FIG. 3 shows a schematic diagram of the relationship between the processor and memory.
Figure 4:
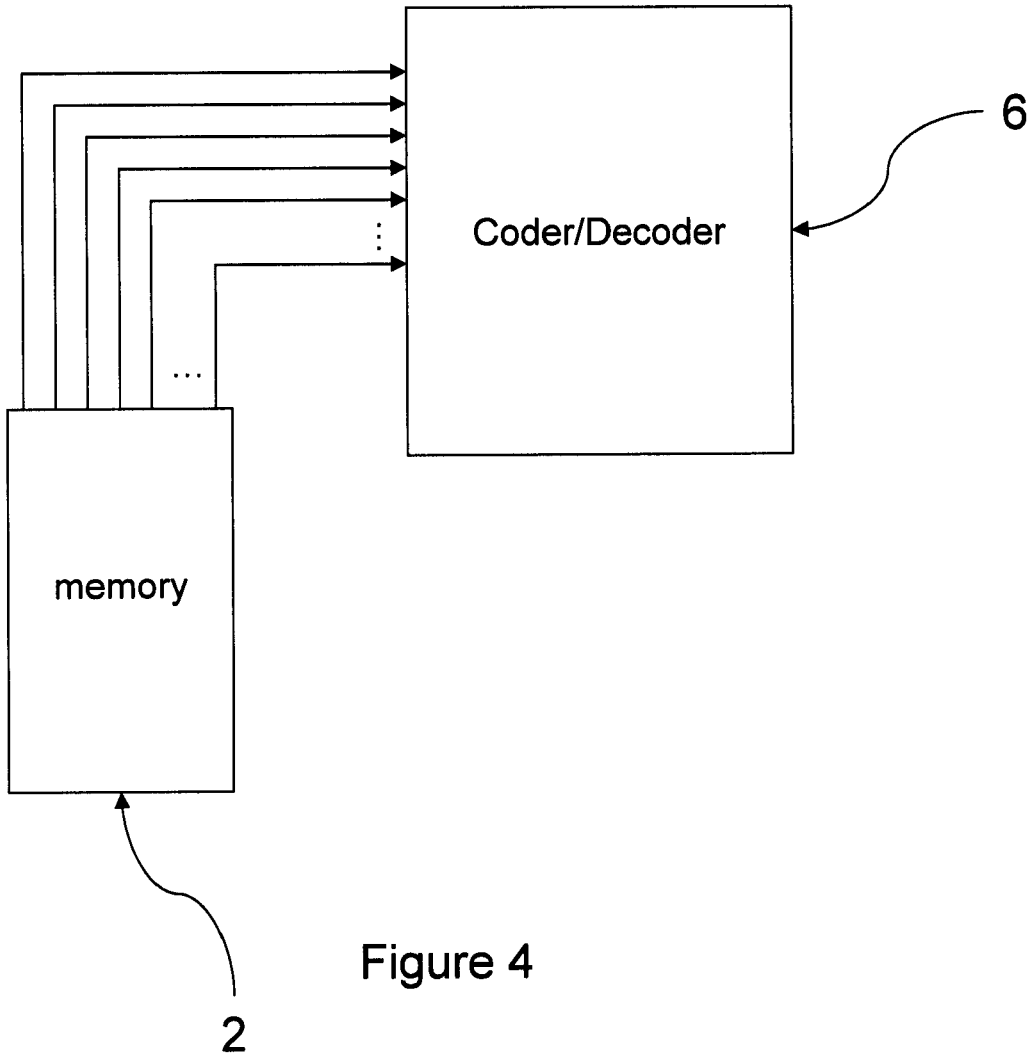
FIG. 4 shows a schematic diagram of the relationship between the processor and the coder/decoder.

Said code vectors c_0, . . . , c_1023 are used within a code excited linear prediction (CELP) coder which is schematically represented in FIG. 2.

The CELP coder is based on a so-called "source-filter" speech production model and comprises both a short-term and a long-term synthesis filter (not displayed) modeling the human vocal tract and the glottal excitation, respectively.

These synthesis filters are jointly represented by a synthesis section SYN which receives a code vector from said codebook CB as input. The code vector is multiplied by a scalar value within a multiplier g (FIG. 2) prior to being processed in said synthesis section SYN.

Within said synthesis section SYN, the code vector is used as excitation sequence to synthesize speech, the synthesized speech signal s' being available at the output of the synthesis section SYN.

For speech coding, the synthesized speech signal s' is subtracted from the speech signal s that is to be coded, which leads to an error signal indicating a difference between the synthesized speech signal s' and the actual speech signal s. After filtering said error signal in a perceptual weighting filter W that reduces information imperceptible to humans, the mean square error is evaluated yielding an error energy P_e, which characterizes the code vector used as excitation sequence beforehand.

This procedure is conducted for each of the 1024 code vectors of said codebook CB, which finally leads to an optimal code vector that is characterized by having a minimal error energy P_e_opt. The optimal code vector is found by performing a codebook search.

Figure 1:
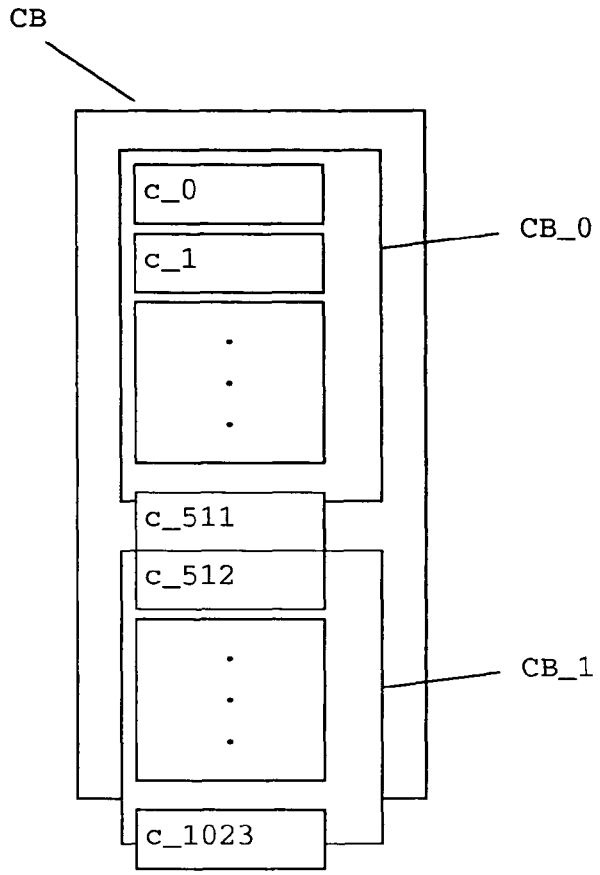
FIG. 1 shows a codebook.

To accelerate the process of calculating the optimal code vector, the codebook CB is divided into p=2 codebook groups CB_0, CB_1 as can be seen in FIG. 1. In the present case, codebook group CB_0 comprises code vectors c_0, . . . , c_511, whereas the second codebook group CB_1 comprises code vectors c_512, . . . , c_1023.

For each of said two codebook groups CB_0, CB_1, an optimal group code vector is determined in parallel by simultaneously performing a codebook search in the respective codebook group CB_0, CB_1 with an acceleration module 3.

A standard codebook search is described in M. R. Schroeder and B. S. Atal, "Code-excited linear predicition (CELP): High quality speech at very low bit rates" in Proc. of ICASSP-85, (Tampa, Fla.), p. 937-940, IEEE, April 1985. Advanced variants of said standard codebook search comprise extensive numerical simplifications and state-of-the-art complexity reductions as presented in W. B. Kleijn, D. J. Krasinski and R. H. Ketchum, "Analysis and improvement of the vector quantization in SELP" in Proc. of Eusipco-88, (Grenoble, France), p. IV 1043-1046, Eurasip, Elsevier Science Publishers B. V. North-Holland, September 1988, L. M. Trancoso and B. S. Atal, "Efficient search procedures for selecting the optimum innovation in stochastic coders", IEEE Transactions on Acoustics, Speech, and Signal Processing, vol. 38, p. 385-396, March 1990, W. B. Kleijn, D. J. Krasinski and R. H. Ketchum, "Fast methods of the CELP speech coding algorithm", IEEE Transactions on Acoustics, Speech, and Signal Processing, vol. 38, p. 1330-1342, August 1990

W. B. Kleijn, D. J. Krasinski and R. H. Ketchum, "Improved speech quality and efficient vector quantization in SELP" in Proc. of ICASSP-88, (New York), p. S4.4, 155-158, IEEE, 1988

M. Johnson and T. Taniguchi, "On-line and off-line computational reduction techniques using backward filtering in CELP speech coders", IEEE Transactions on Signal Processing, vol. 40, p. 2090-2093, August 1992, C. G. Gerlach, "Beiträge zur Optimalität in der codierten Sprachübertragung", Aachener Beiträge zu digitalen Nachrichtensystemen, Band 5, 1996.

Said advanced variants lead to calculations of a so-called cross term $C_t$ and energy term $E_t$ for t-th code vector c_t. The value of a ratio $C_t/E_t$ which is used as a performance measure for the t-th code vector is the higher or the lower of a corresponding error energy P_e_t characterizing the code vector c_t is. The ratio C/E is used to compare code vectors within said codebook search.

To simplify and accelerate calculation steps required for comparing the ratio $C_{best}/E_{best}$ of a temporarily best code vector with the ratio $C_t/E_t$ of the t-th code vector c_t, a cross multiplication expression $$C_t*E_{best}<E_t*C_{best},$$

which is based on fixed point operations is used for avoiding division operations.

To carry out said comparison and to store indices of code vectors already processed, precalculations yielding said cross multiplication expression for each code vector c_t —according to the invention—are carried out in parallel by using specifically designed calculation units 4 of a specifically designed digital signal processor (DSP) 1 or coder/decoder 6, with configurable hardware 5. Postcalculations after performing said comparison are also performed in parallel.

Alternatively, said precalculations and postcalculations can be carried out by a standard DSP which has a plurality of calculation units comprising multiplicators and adders.

The corresponding computer program controlling the DSP 1 is optimized with respect to parallelism of calculations.

After obtaining the optimal group code vectors of both codebook groups CB_0, CB_1, the optimal group code vectors are compared to each other to get the optimal code vector of the entire codebook CB.

To ensure that the mostly parallel evaluation of the optimal code vector according to the present invention conforms with existing speech coding standards performing this type of vector quantization, the index of the optimal group code vectors is also considered when comparing the optimal group code vectors.

Standardized prior art methods employ a linear search method within the codebook search, starting with index value 0 up to index value 1023 in the present case. Only upon finding a better code vector having a higher performance measure than the presently "best" optimal code vector within this linear search, the presently best code vector is replaced by said better code vector. Otherwise, no changes are applied.

Hence there might be a difference between codebook search results of standardized methods and the method according to the present invention.

To attain absolute conformity with the corresponding standards, the method according to the present invention evaluates said index of the optimal group code vectors and uses the information so obtained for ensuring conformity with the standardized methods.

This is done in case of the above described serial algorithm by preferring the code vector with the smaller index if in a comparison between group code vectors equality regarding said cross multiplication expression occurs.

An additional reduction of execution time is achieved by generating/evaluating elements of matrices representing a transfer function of at least one filter of said synthesis section SYN, and/or elements of auto-correlation matrices used within said CELP-algorithm, in parallel. A significant decrease of execution time can especially be achieved by parallel processing of the elements of said auto-correlation matrices because these matrices must be cyclically re-calculated.

The signal values of said speech signal s and of said elements of said auto-correlation matrices are represented by 16 bit data words, and since a 64 bit memory read instruction, which is stored in memory 2, is provided by the DSP 1, four signal values located in a memory of said DSP 1 are accessed simultaneously which ensures that even in case of simultaneous evaluation of a plurality of signal values input data is always available.

The DSP 1 also has acceleration means implemented on a hardware basis which are specifically designed to evaluate complex expressions that are to be computed repeatedly within few machine cycles.

The method according to the present invention can also be used with standard DSPs that have a plurality of computing means such as multiplicators and adders. In this case, the computer programm controlling the speech coding has to be specifically adapted to the available resources of the standard DSP.

The overall acceleration of the codebook search process that can be achieved with the method according to the present invention ranges from about 200 percent to 500 percent, the method at the same time attaining absolute conformity with existing speech coding standards.

With these improvements it is possible to increase the number of communication channels based on CELP CODECs provided within gateways and transcoders for communication networks thus reducing overall costs.

On the other hand, mobile terminals requiring less energy for CELP coding can be implemented.

The invention claimed is:

1. A method of coding an audio or speech signal using a codebook search of a codebook, comprising:

dividing said codebook into a plurality of codebook groups, where the codebook comprises a plurality of code vectors for vector quantization of a signal vector representing a set of signal values of said audio or speech signal;

simultaneously determining a plurality of optimal group code vectors, each of which corresponds to one of said plurality of codebook groups by performing a comparison of the plurality of code vectors within said codebook search to determine the optimal code vector, wherein said comparison is based on cross multiplication expression $$C_t*E_{best}<E_t*C_{best},$$

calculated in parallel for every vector, which is based on fixed point operations performed, wherein $C_t$ is a cross term corresponding to a t-th code vector and $C_{best}$ is the cross term corresponding to a temporarily best code vector, and wherein $E_t$ is a energy term corresponding to said t-th code vector and $E_{best}$ is the energy term corresponding to said temporarily best code vector;

determining an optimal code vector of said codebook from said plurality of optimal group code vectors; and outputting the optimal code vector, wherein said determining of said optimal code vector among said plurality of optimal group code vectors comprises evaluating an index of each optimal group code vector uniquely identifying each optimal group code vector within said codebook, wherein the evaluating the index comprises comparing the index of each optimal group code vector with indices of other optimal group code vectors;

wherein the comparing of the index of each optimal group code vector is different from a comparison between the group code vectors; and wherein the evaluating the index further comprises selecting a code vector with a smaller index as a result of comparing the indices of the optimal group code vectors if equality regarding the cross multiplication expression occurs in a comparison between optimal group code vectors.

2. The method according to claim 1, wherein said vector quantization is of a shape-gain type.

3. The method according to claim 1, wherein said method is based on a code excited linear prediction (CELP) algorithm comprising a synthesis section, and wherein elements of autocorrelation matrices used within said CELP-algorithm are generated/evaluated in parallel.

4. The method according to claim 1, wherein said codebook comprises pulse code vectors.

5. The method according to claim 1, wherein each codebook group comprises a number of code vectors wherein the number of code vectors is a fraction of the plurality of code vectors.

6. The method according to claim 1, wherein each code vector is uniquely identifiable by a unique index.

7. The method according to claim 6, wherein the code vectors contained in a first codebook group are mutually exclusive from the code vectors contained in a second codebook group.

8. The method according to claim 1, wherein said evaluating an index of each optimal group code vector ensures conformity with a linear search method.

9. The method according to claim 1, further comprising obtaining conformity with a linear search method by said comparing the index of each the optimal group code vector with the indices of the other optimal group code vectors.

10. A coder and a decoder that performs the method according to claim 1, wherein the coder and decoder are at least one of speech and audio signal CODECs.

11. A processor for coding an audio or speech signal, wherein the processor comprises:

configurable hardware with an acceleration module which performs codebook search comprising:

dividing module which divides said codebook into plurality of codebook groups, where the codebook comprises a plurality of code vectors for vector quantization of a signal vector representing a set of signal values of said audio or speech signal;

first set of determination units which simultaneously determines plurality of optimal group code vectors, where each of the plurality of optimal group code vectors corresponds to one of said plurality of codebook groups; and second determination unit which determines said optimal code vector of said codebook from the plurality of optimal group code vectors; and an outputting module which outputs said optimal code vector, wherein the codebook search is performed in parallel execution, wherein said second determination unit determining said optimal code vector among said plurality of optimal group code vectors comprises evaluating an index of each optimal group code vector uniquely identifying each optimal group code vector within said codebook, wherein a comparison of the plurality of code vectors within said codebook search is performed to determine the optimal code vector, wherein said comparison is based on cross multiplication expression $$C_t * E_{best} > < E_t * C_{best},$$

calculated in parallel for every vector, which is based on fixed point operations, wherein $C_t$ is a cross term corresponding to a t-th code vector and $C_{best}$ is the cross term corresponding to a temporarily best code vector, and wherein $E_t$ is a energy term corresponding to said t-th code vector and $E_{best}$ is the energy term corresponding to said temporarily best code vector, wherein the evaluating the index comprises comparing the index of each optimal group code vector with indices of other optimal group code vectors;

wherein the comparing of the index of each optimal group code vector is different from a comparison between the group code vectors; and wherein the evaluating the index further comprises selecting a code vector with a smaller index as a result of comparing the indices of the optimal group code vectors if equality regarding the cross multiplication expression occurs in a comparison between optimal group code vectors.

12. The processor according to claim 11 further comprising means for simultaneously accessing a plurality of said signal values located in a memory.

13. The processor according to claim 11, wherein the processor is a standard processor further comprising calculation module wherein the standard processor performs the parallel execution of said codebook search, and wherein said codebook search is optimized regarding at least one of the calculation module of said standard processor and execution time.

14. The processor according to claim 11, wherein the processor is a digital signal processor.

15. The processor according to claim 11, further comprising a plurality of calculation units, each of which determines optimal group code vectors of a respective one of the plurality of codebook groups, wherein the plurality of calculation units execute said determining simultaneously.

* * * * *